US008117733B2

(12) United States Patent
Reggiani et al.

(10) Patent No.: US 8,117,733 B2
(45) Date of Patent: Feb. 21, 2012

(54) APPARATUS AND METHOD FOR REMOVING A FILM OF A PACKAGE OF OBJECTS

(75) Inventors: Giuseppe Reggiani, Sant'ilario D'enza (IT); Cesare Corradi, Cadelbosco di Sopra (IT)

(73) Assignee: Clevertech S.R.L., Cadelbosco di Sopra (IT)

( * ) Notice: Subject to any disclaimer, the term of this patent is extended or adjusted under 35 U.S.C. 154(b) by 302 days.

(21) Appl. No.: 12/424,272

(22) Filed: Apr. 15, 2009

(65) Prior Publication Data

US 2009/0261139 A1 Oct. 22, 2009

(30) Foreign Application Priority Data

Apr. 18, 2008 (IT) ..... PR2008A0024

(51) Int. Cl.
*B23P 19/04* (2006.01)
*B65B 69/00* (2006.01)

(52) U.S. Cl. ..... 29/564.3; 53/381.2; 53/384.1; 83/18; 83/924

(58) Field of Classification Search ..... 29/564.3, 29/564.7, 426.4; 53/492, 381.1, 381.2, 384.1; 414/412; 83/924, 18
See application file for complete search history.

(56) References Cited

U.S. PATENT DOCUMENTS 3,080,014 A * 3/1963 Dahl ..... 181/209
4,344,268 A 8/1982 Wakamatsu et al.
4,997,329 A * 3/1991 Hanamoto et al. ..... 414/412
5,613,346 A * 3/1997 Yamamichi et al. ..... 53/381.1
2010/0218458 A1* 9/2010 Benini et al. ..... 53/381.2

FOREIGN PATENT DOCUMENTS

| | | | |
|---|---|---|---|
| EP | 0 947 428 | A1 | 10/1999 |
| EP | 1 532 050 | A0 | 5/2005 |
| EP | 2221251 | A1 * | 8/2010 |
| GB | 2 105 288 | A | 3/1983 |
| JP | 58-041030 | A * | 3/1983 |
| JP | 2 166034 | A | 6/1990 |
| JP | 05-124631 | A * | 5/1993 |
| JP | 05-139426 | A * | 6/1993 |
| JP | 09-221116 | A * | 8/1997 |
| WO | 03/091115 | A1 | 11/2003 |

OTHER PUBLICATIONS

Partial Translation of JP 58-041030-A, which JP '030 was published Mar. 1983.*

* cited by examiner

*Primary Examiner* — Erica E Cadugan
(74) *Attorney, Agent, or Firm* — Pearne & Gordon LLP

(57) ABSTRACT

An apparatus (1) for removing a film (2) of a package (3) of objects having an elongated shape along a longitudinal axis comprises two pairs of rollers (7 and 12) suitable for pressing on the film (2) externally to hold the package (3) in place in a removal station (8); the two pairs of rollers are operatively connected to respective motor drives so as to apply a mechanical stretching to portions (13 and 14) of the film (2) in order to tear them, thus enabling the first pair (7) of rollers to remove the film (2) and free the objects from the package. Known film removal apparatus require a device for cutting the packaging film longitudinally, so that the speed of the apparatus is limited according to the length of the package and there is a risk of objects being damaged during cutting.

9 Claims, 6 Drawing Sheets

APPARATUS AND METHOD FOR REMOVING A FILM OF A PACKAGE OF OBJECTS

The present invention relates to an apparatus and method for removing a film of a package of objects.

In particular, the present invention relates to an apparatus and method for removing a film of a package having an elongated shape in a longitudinal direction, for example (but not necessarily), a package with a substantially cylindrical shape.

Said package is in particular a package of lids (e.g. lids to be seamed onto containers) which have been stacked and subsequently wrapped in a film; the packaging film consists, for example, of a heat shrink film of plastic material. This film is ordinarily sealed around the bundle of objects by means of a weld formed along a longitudinal line (substantially coinciding with a generatrix of the cylindrically shaped package). The packaging film covers the lateral surface of the package and also (at least partly) the surfaces on either end of the package.

Within this field, there are known unwrapping machines for automatically removing the packaging film in order to free the objects from the film and make them available for subsequent processing.

Generally speaking, such machines involve (according to what is described, for example, in U.S. Pat. No. 4,344,268 or EP 1532050) loading the packages one at a time in a cutting station or a film removal station, wherein the package is inserted between rollers while one or more mobile cutting heads make a longitudinal slit in the film.

In particular, such unwrapping machines comprise:

- a first and a second roller defining a first pair of rollers, disposed along parallel longitudinal axes to support the package in a film removal station and connected to a first motor drive serving to rotate them around said axes;
- a third and a fourth roller defining a second pair of rollers, movable between a raised position of non-interference with the package disposed in the removal station and a lowered position in which they bear down upon the package, pressing it against said first and second roller;
- cutting heads (e.g. blades or nozzles connected to a source of hot air) that move longitudinally to tear the film of the package disposed in the removal station by cutting it longitudinally, thereby enabling the removal thereof by the first pair of rollers.

Such technical solutions present several disadvantages.

First of all, the time necessary for cutting the film (and on which the hourly output of the unwrapping machine depends) is proportional to the length of the package (i.e. the extension of the package in the longitudinal direction).

A further disadvantage is associated with the cutting means and depends on the type used.

If the cutting means comprise blades or cutters, there is a risk of damaging the underlying objects.

If the cutting means comprise nozzles connected to a source of hot air, there is a risk that the film, either by burning or melting, will generate fragments that adhere to the objects, thereby dirtying them, or even generate toxic, harmful fumes.

Some of the known unwrapping machines attempt to provide technical solutions for these problems by including suction means to draw up the portion of film whereupon the cutting means act (for example, according to what is described in EP 0947428). However, the presence of suction means introduces further drawbacks in that it increases the complexity and cost of the apparatus while reducing its speed.

Other technical solutions (such as the one described, for example, in GB 2105288) provide for the package to be pushed perpendicularly to its longitudinal axis in order to force the film to pass between the first pair of rollers, so it can be gripped there by jaws and pulled away from the package.

This solution, too, is disadvantageous, since it does not allow the removal of particularly resistant films and entails submitting the objects to particularly elevated mechanical stresses, with the risk of damaging them.

The object of the present invention is to eliminate the aforesaid drawbacks and provide an apparatus and method for removing a film of a package of objects in an especially fast and efficient manner without denting or damaging the objects.

Said object is fully achieved by the apparatus of the invention, which is characterised as described in the claims appended below, and in particular by the fact that the means for tearing the film comprise a second motor drive, which is connected to the second pair of rollers and rotates them around their longitudinal axes in such a way as to stretch portions of the film disposed between the surfaces in contact with said first and second pair of rollers, thereby causing it to tear.

The method according to the present invention is characterised as described in the claims appended below and in particular by the fact that it comprises the following phases, in succession:

- placing of the package on a first pair of rollers comprising a first and second roller for longitudinally supporting the package in a film removal station;
- moving of a second pair of rollers, comprising a third and fourth roller connected to a second motor drive, from a raised position of non-interference with the package disposed in the removal station to a lowered position, in which the second pair of rollers bears down upon the package, pressing it against the first pair of rollers;
- rotating the rollers around their longitudinal axes, in such a way as to stretch portions of the film disposed between the surfaces in contact with said first and second pair of rollers, thereby causing it to tear;
- removing of the film by the first pair of rollers.

These and other characteristics will become more apparent from the following description of a preferred embodiment, illustrated solely by way of non-restrictive example in the appended drawings, in which.

Figure 1:
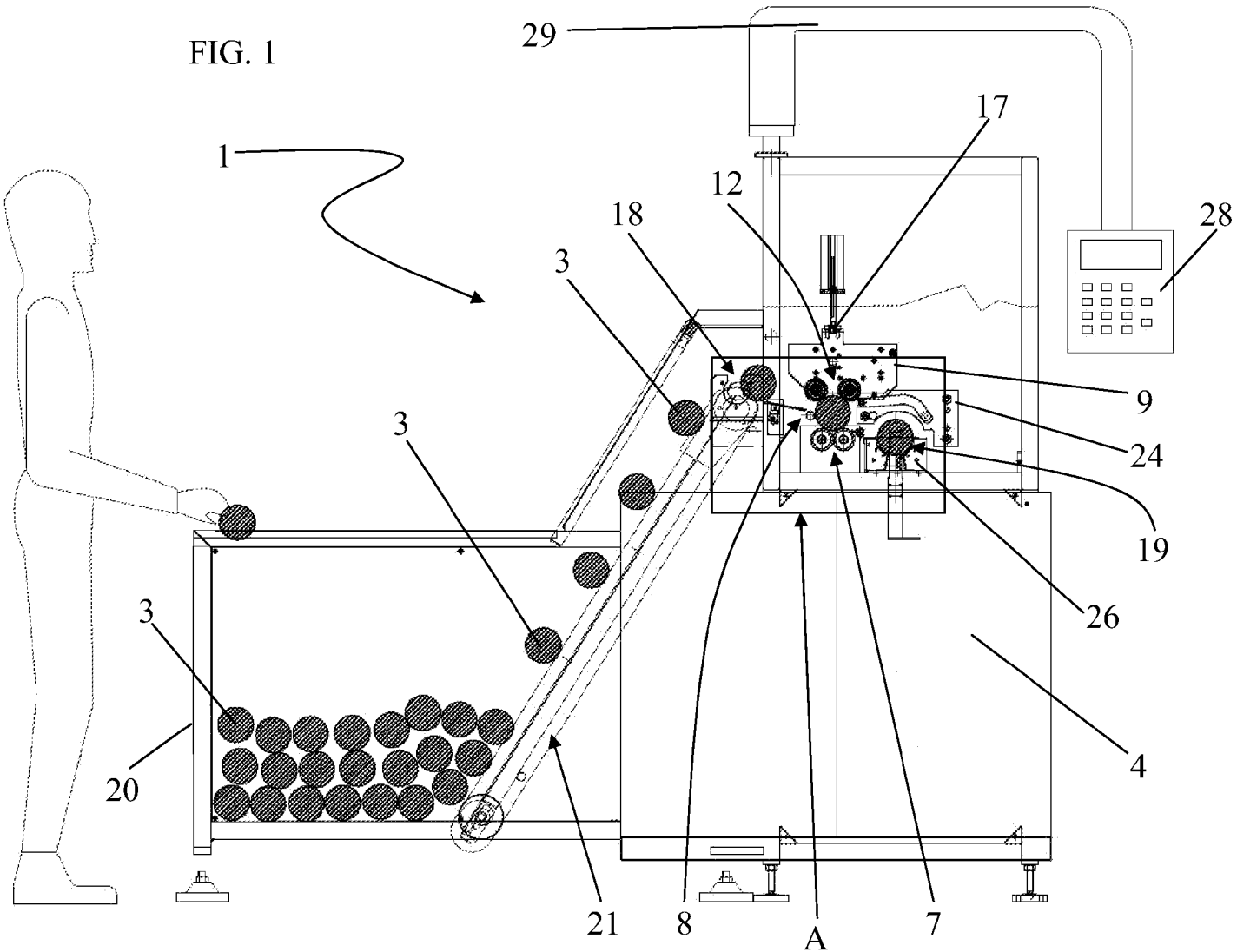
FIG. 1 illustrates an open lateral view of the apparatus according to the present invention.
Figure 2:
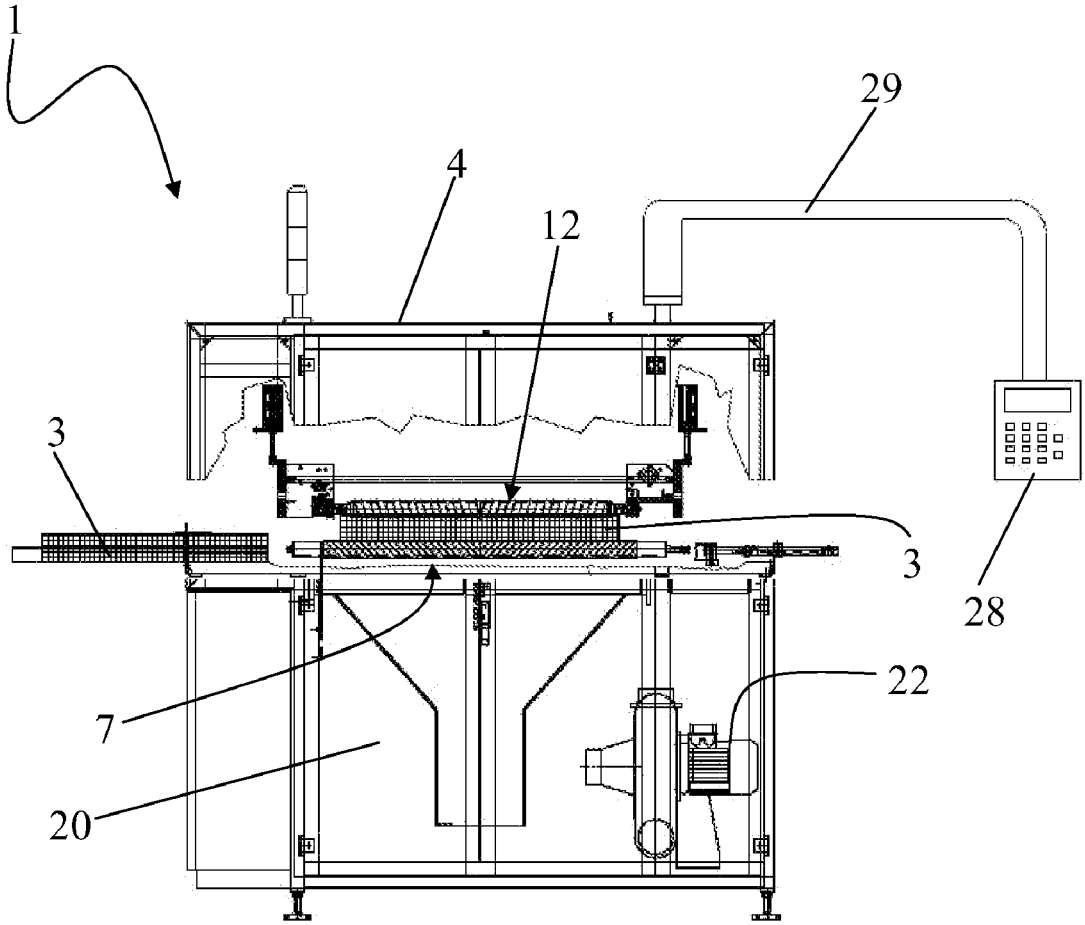
FIG. 2 illustrates a partly open front view of the apparatus of FIG. 1.
Figure 3:
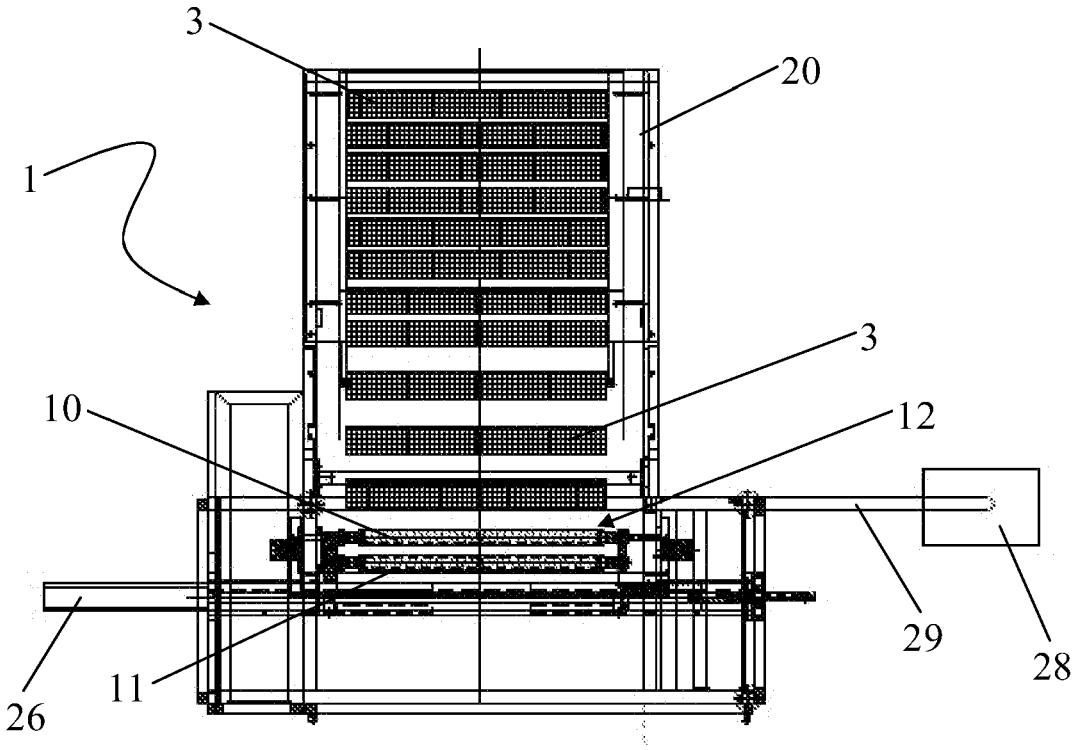
FIG. 3 illustrates the apparatus of FIG. 1 as viewed from above.
Figure 5:
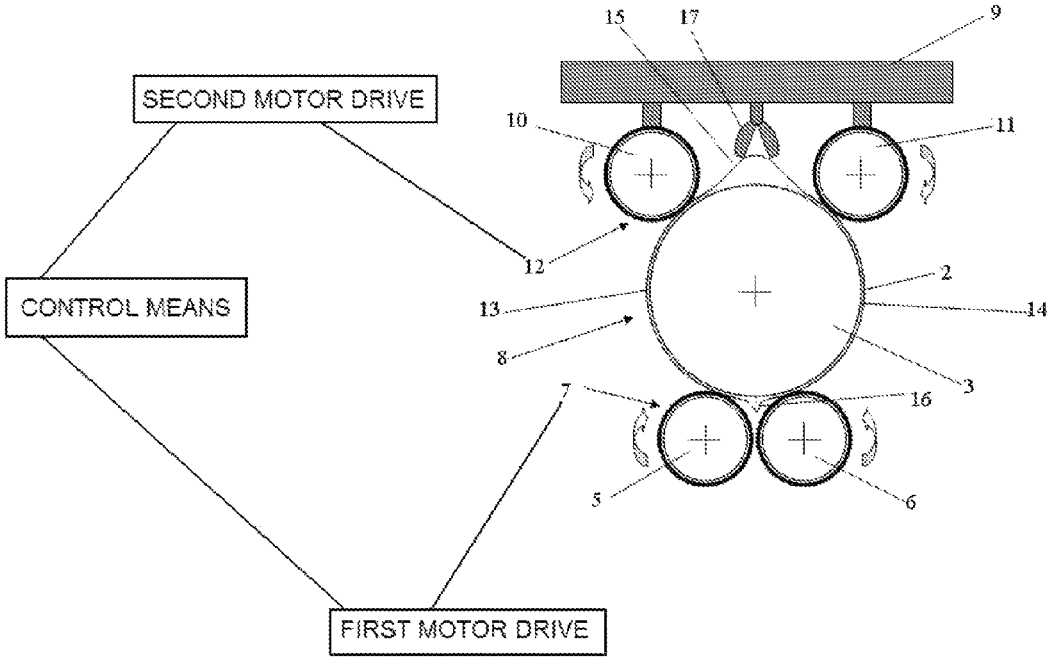
Figure 6:
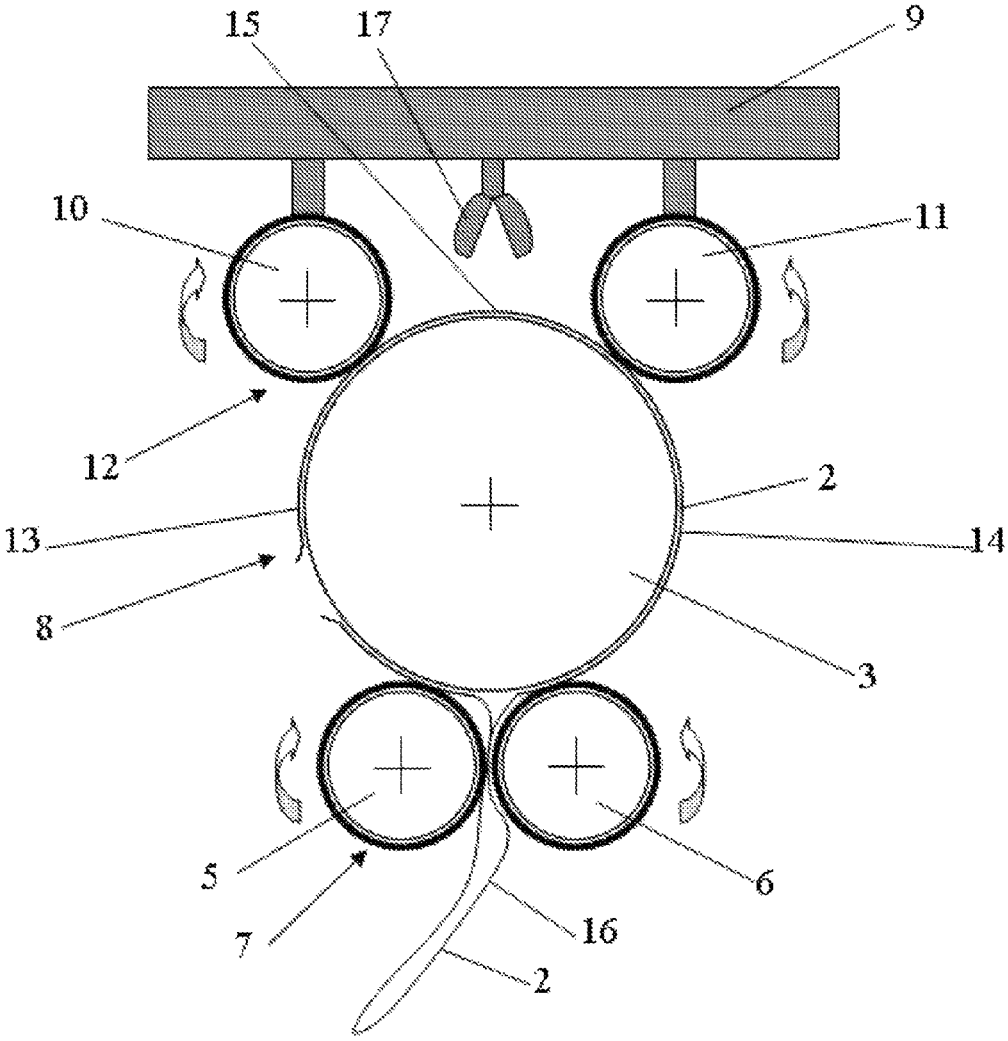

FIG. 5 schematically illustrates a detail of the apparatus of FIG. 1 during an operating phase of the method according to the present invention;

FIG. 6 illustrates the detail of FIG. 5 during a different operating phase.

With reference to the figures, 1 indicates an apparatus for removing a film 2 of a package 3 of objects having a shape elongated along a longitudinal axis. In a typical application, the objects are lids placed side by side to form a stack, or a bundle of objects stacked adjacent to one another.

The present invention relates to packages having a generally cylindrical shape; however, it can also be applied to packages having different shapes, e.g. packages with an elliptical or square cross section or packages shaped like frustum of cones.

The films 2 used for the packages 3 are generally plastic films, e.g. heat shrink films, wrapped around the set of objects and applied by welding along a longitudinal line (substantially coinciding with a directrix of the package 3, in cases where the package has a substantially cylindrical shape, as in the example illustrated).

The apparatus 1 comprises a frame 4, rotatably associated with which there is a first roller 5 and a second roller 6 defining a first pair 7 of rollers; these rollers define respective longitudinal axes and are disposed in such a way as to longitudinally support a package 3.

The first pair 7 of rollers defines a station 8 for removal of the film 2 of the package 3 supported thereupon.

The first and second roller are connected to a first motor drive serving to rotate them around said longitudinal axes. The first motor drive (not illustrated in the figures) comprises, for example, an electric motor, according to a known solution.

Movably associated with the frame 4 there is a carriage 9, which moves vertically along an axis perpendicular to the longitudinal axes of the first pair 7 of rollers; in particular, the carriage 9 is movable between a lowered position and a raised one, respectively closer to and further away from the first pair 7 of rollers.

The apparatus also comprises a third roller 10 and a fourth roller 11 defining a second pair 12 of rollers, rotatably associated with the carriage 9.

As a result, said third and fourth rollers are able to move (integrally with the carriage 9) between a raised position of non-interference with the package 3 disposed in the removal station 8 and a lowered position, in which they bear down upon the package 3, pressing it against said first and second rollers.

Therefore, the second pair 12 of rollers cooperates with the first pair 7 of rollers to exert a predetermined pressure upon the outer surface of the package 3 disposed in the removal station 8, thereby holding it in place in said station.

In the preferred embodiment illustrated, the first roller 5 and the second roller 6 are disposed near each other, so that their lateral surfaces are mutually in contact. In this regard, it should be observed that means are also provided for pressing the first roller 5 and the second roller 6 against each other; preferably, such means comprise pneumatic pistons. The apparatus 1 also comprises, innovatively, a sensor (not illustrated) connected to an actuator of the pneumatic pistons and operatively active upon them so as to detect directly or indirectly, a mechanical force applied to the pistons (i.e. the means for pressing the first roller 5 and the second roller 6 against each other) in opposition to their action. In other words, the sensor detects the forces applied by the first roller 5 and by the second roller 6 against the pistons, that is, forces tending to push one piston away from the other. The sensor is connected to the actuator of the pistons by means of a control logic, so that when said force detected by the sensor exceeds a predetermined reference threshold, the actuator will temporarily allow the first roller 5 to move away from the second roller 6 (for example by reducing the pressure mutually exerted by the two rollers or even moving them away from each other). This allows, advantageously, relatively bulky and rigid objects to pass between the first pair 7 of rollers, thus avoiding jamming or breakage of the apparatus. The result is a better reliability of the apparatus (and of the method according to the present invention).

The third roller 10 and the fourth roller 11 are preferably disposed at a predetermined distance from each other (for example, around 25-30 mm), so as to favour a good hold of the second pair 12 of rollers on the package 3, even in the case of packages 3 of different diameters.

In the preferred embodiment illustrated, the rollers have a substantially cylindrical shape; moreover, the rollers preferably have longitudinal axes that are mutually parallel (and parallel to the longitudinal axis of the package 3 in the removal station 8). This makes the apparatus 1 especially suitable for handling packages 3 with a substantially cylindrical shape.

However, unillustrated variants of the present invention envisage that the rollers have longitudinal axes which are not parallel to each other; it is also envisaged that the rollers may be in the shape of a frustum of cone (for example for the handling of cone-frustum shaped packages) or be configured with other shapes according to the shape of the package to be handled.

In any event, it is essential for the rollers to be suitably configured so as to come into contact with the package 3 disposed in the cutting station along portions of the film 2 wrapping the package 3 itself which define contact surfaces (in the example illustrated such contact surfaces or portions substantially consist in directrices of the cylinder defined by the package 3).

The apparatus 1 also comprises a second motor drive, operatively connected to the third roller 10 and the fourth roller 11 so as to rotate them around their longitudinal axes. This second motor drive, not illustrated in the figures, comprises for example an electric motor of a known type.

Innovatively, the second motor drive is connected to the second pair 12 of rollers in order to rotate them so that they stretch (lateral) portions of the film 2 (of the package 3 disposed in the removal station 8) disposed between the surfaces in contact with said first and second pair of rollers, thereby causing it to tear.

In particular (with reference to FIG. 5), said (lateral) portions comprise:

- a first (lateral) portion 13 disposed between the surface of the first roller 5 in contact with the film 2 and the surface of the third roller 10 in contact with the film 2;
- a second (lateral) portion 14 disposed between the surface of the second roller 6 in contact with the film 2 and the surface of the fourth roller 11 in contact with the film 2.

Therefore, the pairs of rollers and respective motor drives constitute means for tearing the film 2 of the package 3 disposed in the removal station 8 by virtue of the mechanical stretching to which the film 2 is subjected.

For this purpose, the first motor drive is operatively connected to the first roller 5 and to the second roller 6 so as to rotate them in opposite directions, in such a way that the surfaces contacting with the film 2 of the package 3 disposed in the removal station 8 instantly move closer to each other (as is illustrated in FIG. 5; in the view shown in FIG. 5, the first roller 5 is rotating in a clockwise direction and the second roller 6 is rotating in an anticlockwise direction).

Moreover, the second motor drive is operatively connected, in an original manner, to the third roller 10 and to the fourth roller 11 so as to rotate them in opposite directions, in such a way that the surfaces contacting with the film 2 of the package 3 disposed in the removal station 8 instantly move closer to each other (in the view shown in FIG. 5, the third roller 10 is rotating in an anticlockwise direction and the fourth roller 11 is rotating in a clockwise direction).

As a result, when the pairs of rollers are moved as described above, said lateral portions 13 and 14 of the film 2 are stretched, while the portions of film 2 disposed between the contact surfaces of the rollers belonging to the same pair are slackened, so that said portions of the film 2 are lifted or detached from the objects of the package 3.

In particular, the portions of film 2 lifted during said movement of the rollers comprise:

an upper portion 15 disposed between the surface of the third roller 10 in contact with the film 2 and the surface of the fourth roller 11 in contact with the film 2;

a lower portion 16 disposed between the surface of the first roller 5 in contact with the film 2 and the surface of the second roller 6 in contact with the film 2.

It should be observed that, according to the present invention, the film 2 is torn, in an original manner, by virtue of the mechanical stretching applied by the rollers to portions of the film 2, said stretching exceeding a critical breaking value.

This critical value is reached in weak areas of the film 2; thus tearing begins in such weak areas of the film 2 and continues therefrom. These weak areas are typically associated with discontinuities in the film 2 or defects in the material the film 2 is made of.

Generally speaking, one weak area is the welded seam of the film 2, disposed longitudinally on the lateral portion of the film 2. Other weak points may be holes or nicks present in the film 2 wrapping the package 3.

It should also be observed that, as a result of the tearing, the lower portion 16 of the film 2 progressively increases under the action of the first pair 7 of rollers (as is schematically illustrated in FIG. 6), until the entire film 2 of the package 3 passes between the first pair 7 of rollers (between the first roller 5 and the second roller 6) and is discharged downward (for example, it may fall by gravity into a film collection container).

Therefore, the combined action of the first and second pair of rollers serves to tear the film 2; the first pair 7 of rollers also achieves the removal of the film 2.

In this regard, it should be observed that it is important to prevent the tearing of the film 2 occurring in the lower portion 16 of the film 2, since this would risk prejudicing the recovery of the film 2 by the first roller 5 and the second roller 6 and hence the correct removal of the film 2.

The apparatus 1 also comprises, innovatively, an electronic card (not illustrated because of a known type; it should be observed that in place of the electronic card, a PLC or other known alternative devices may be used), which is programmed to control the first and the second motor drives.

Moreover, the apparatus 1 also comprises, innovatively, means of reversing the direction of rotation of said third and fourth rollers cooperating with the second motor drive. Said reversing means preferably consist in an electric driver (not illustrated) of the electric motor constituting the second motor drive, which is able to reverse the direction (or invert the sign) of the motor control current. However, such reversing means may also be achieved using different technical solutions (according to known techniques), also depending on the type of the second motor drive.

The reversing means are connected to the electronic card; therefore, said card constitutes control means connected to said first and second motor drives and to said reversing means in order to control them based on a pre-established operating mode (set by programming the card itself).

It should be observed that the reversing means are controlled in such a way as to simultaneously reverse the direction of rotation of the third roller 10 and of the fourth roller 11, so that said rollers always rotate in mutually opposite directions.

Operatively, the control means are connected to said first and second motor drive and to said reversing means so as to alternately stretch the lateral portions 13 and 14 of the film 2 and the upper portion 15 of the film 2, in successive phases.

In fact, the control means reverse the directions of rotation of the second pair 12 of rollers, without reversing the directions of rotation of the first pair 7 of rollers. As a result, after the reversal the two pairs of rollers rotate in a mutually concordant fashion (as shown in FIG. 6, the first roller 5 and the third roller 10 rotate in a clockwise direction, the second roller 6 and the fourth roller 11 rotate in an anticlockwise direction).

In this operating configuration, the upper portion 15 of the film 2 is stretched. This advantageously results in the tearing of the film 2, starting from the upper portion 15; this is important also considering the eventuality that the previously stretched lateral portions 13 and 14 of the film 2 were devoid of weak areas.

It is possible, indeed, that when the package 3 is disposed in the removal station 8, the weak area (or weak areas) of the film 2 are to be found in the upper portion 15 of the film 2. In such a case, the tearing of the film 2 will occur starting from said upper portion 15 of the film 2 after the reversal in the direction of rotation of the second pair 12 of rollers.

This makes it possible, advantageously, to limit the amount of stretching force applied to the portions of the film 2, while nonetheless guaranteeing the tearing of the film 2 itself; it also makes it possible, advantageously, to limit the amount of pressure exerted by the rollers on the package, thus avoiding the risk of damaging the lids (for example by deforming them).

Reversing the direction of rotation of the second pair 12 of rollers enables both the portions 13 and 14 and the portion 15 of the film 2 to be stretched, making it particularly likely that the weak area of the film 2 will undergo stretching.

In this regard, it should be observed that the apparatus 1 also comprises, innovatively, at least one pair of shears 17 suitable for making an incision in the upper portion 15 of the film 2, when said portion 15 is lifted away from the objects of the package 3 by virtue of the action of the second pair 12 of rollers (as schematically illustrated in FIG. 5).

Therefore, said at least one pair of shears 17 constitutes means of cutting the film 2, being operatively active on the portion 15 of the film 2 (of the package 3 disposed in the removal station 8) disposed between the portions in contact with the third and the fourth roller, said cutting means interacting with the second motor drive to make cuts in the film 2 when said portion is lifted away from the objects of the package 3 by virtue of the rotation of the second pair of rollers (in the operating configuration illustrated in FIG. 5).

Preferably, said at least one pair of shears 17 is associated with the carriage 9 and moves integrally with it; preferably, the apparatus 1 comprises a plurality of shears 17 associated with the carriage 9, disposed along the longitudinal axis of the package 3 and spaced apart so as to make a plurality of incisions in the film 2.

It should be observed that, as an alternative to the shears, it is possible to use rotary blades or retractable needles (suitable for punching or making holes in the film 2), made to slide along the longitudinal axis of the package 3, or other means suitable for defining a weak area in the upper portion 15 of the film 2.

The cutting means (shears or rotary blades or needles) 17 are operatively linked to the electronic card (i.e. the control means), so that the action of the cutting means 17 is coordinated with the movement of the carriage 9 and with the action of the second pair 12 of rollers.

This ensures, advantageously, that even in the event (scarcely likely but possible in principle) that the weak area of the film 2 is in the lower portion 16 of the film 2 when the package 3 is in the removal station 8, the upper portion 15 of the film 2 will tear upon being stretched by the second pair 12 of rollers.

In this regard, it should be observed that the present invention makes it possible, advantageously, to ensure the correct tearing of the film 2 (i.e. tearing in a portion of film 2 not positioned between the first roller 5 and the second roller 6, since it is desired that the film 2 be collected and discharged through a defined passage between said first and second roller) by applying to the film 2 a mechanical stretching of limited value (i.e. corresponding to the value sufficient to tear the film 2 in a weak area), irrespective of the position assumed by the package 3 in the removal station 8 relative to a rotation around its longitudinal axis.

In fact, the present invention does not require the presence of means for placing the package 3 in the removal station 8 in a position where it is rotated around its longitudinal axis in such a way as to dispose the weak area of the film 2 of the package 3 in a predetermined position; the correct tearing of the film 2 and the correct removal thereof are guaranteed irrespective of the angular position of the package 3 in the removal station 8 (relative to the longitudinal axis of the package 3 itself).

It should also be considered that the removal of the film 2 will take place without any problems also in the event that the film 2 is torn in a plurality of areas, for example in the event that it is torn both in one of the lateral portions 13 or 14 and in the upper portion 15. Indeed, at either end of the package 3, the film 2 does not tear (as the portions of the film 2 disposed on planes perpendicular to said longitudinal axis are not subjected to mechanical stretching); on the one hand this circumstance in no way prejudices the removal of the film 2, while on the other hand it prevents scraps of film 2 coming detached from the remaining part of the film 2, which would result in the risk of such scraps not being recovered and conveyed downward through the first pair 7 of rollers.

It should moreover be observed that the present invention also envisages the presence of a number of rollers other than four (e.g. a larger number), to be applied exploiting the teachings described above.

In any case, the rollers comprised in the apparatus 1 have preferred characteristics intended to optimise the friction generated between the rollers and the film 2 of the package 3, that is to optimise the grip of the rollers on the package 3.

In this regard, it should be observed that the rollers are preferably coated with a layer of rubber. Such rubber is preferably applied to a core of the roller (made of steel for example) by means of a vulcanization process. Hence, the rollers are preferably coated with layers of rubber vulcanised to their cores.

Furthermore, said rollers preferably have rough lateral surfaces, such as to optimise the friction along the contacting surfaces between the rollers and the film 2 of the package 3 disposed in the removal station 8.

In particular, the rollers have lateral surfaces with a helical profile, preferably with herringbone teeth. This helical profile is preferably obtained by means of a grinding process performed on the rubber layer applied on the outside of the rollers.

Furthermore, said rollers preferably have lateral layers of predetermined hardness (approximately 60-80 degrees Sh and, preferably, 70 degrees Sh), such as to optimize the friction along the contacting surfaces between the rollers and the film 2 of the package 3 disposed in the removal station 8.

Such characteristics of the rollers are important in order to obtain the desired values of mechanical stretching applied to the film 2, using particularly modest amounts of pressure exerted by the rollers on the package, thus avoiding the risk of damaging the objects (for example by causing the deformation thereof).

It should be observed that the present apparatus defines, in addition to the removal station 8, an entry station 18 and an exit station 19 for the package 3.

Figure 4:
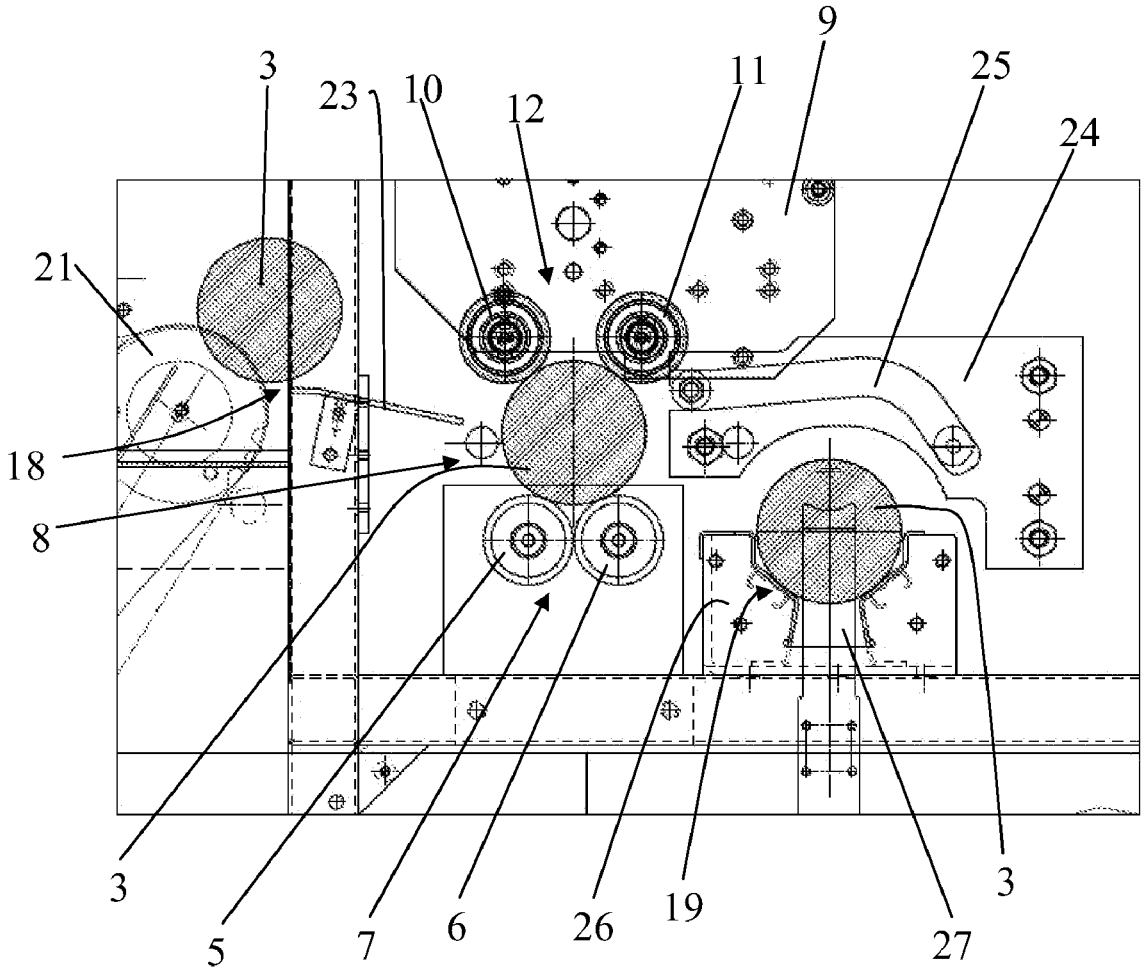
FIG. 4 illustrates an enlargement of detail A of FIG. 1.

In this regard, FIG. 4 illustrates three packages 3 disposed in the entry station 18, in the removal station 8 and in the exit station 19, respectively; the removal station 8 lies at an intermediate point between the entry station 18 and the exit station 19, relative to the path of conveyance of the packages 3 inside the apparatus 1.

The apparatus 1 also includes a system for loading the packages 3, which comprises:

a container 20 for storing the packages 3;

a belt 21 for conveying the packages 3, preferably disposed in an inclined position and driven by a motor 22;

The belt 21 is provided with teeth (not illustrated), disposed longitudinally and preferably evenly spaced, in order to pick up one package 3 at a time and feed it to the entry station 18. In particular, in the entry station 18 the package 3 rests against a chute 23 and is still interacting with the conveyor belt 21.

It should be observed that the motor 22 is preferably a gearmotor cooperating with a brake (according to a technique known per se).

The motor 22 is operatively connected to the electronic card (i.e. to the control means), so that its operation may be coordinated with that of said first and second motor drive.

The apparatus 1 comprises a photocell (not illustrated and of a known type), which is connected to the control means and serves to detect the presence of a package 3 in the entry station 18.

Operatively, the conveyor belt 21 moves each package 3 until carrying it into the entry station 18; in the entry station 18, the presence of the package 3 is detected by a photocell and a signal is transmitted to the control means; in this situation the conveyor belt 21 stops and remains stationary, awaiting instructions from the control means to which it is connected.

In response to a signal from the control means (which verify that the removal station 8 is not occupied by another package), the conveyor belt 21 starts moving again; said movement of the conveyor belt 21 has the effect of pushing the package 3 disposed in the entry station 18 toward the chute 23. As a result the package 3 rolls along the chute 23 until reaching (by gravity) the removal station 8.

It should be observed that the control means are programmed in such a way as to coordinate the pushing of the package from the entry station 21 (and the consequent conveyance thereof into the removal station 8) with the movement of the carriage 9, so that the carriage 9 will be in the raised position of non-interference when the package 3 reaches the removal station by means of the chute 23.

The apparatus 1 also comprises, innovatively, a platform 24 slidingly associated with a cam 25 defined by the frame 4. The platform 24 is movable from a first position to a second position along a transverse trajectory (i.e. a trajectory that is maintained perpendicular to the longitudinal direction in which the longitudinal axes of the packages 3 are disposed).

Associated with the platform 24 there are two hydraulic (or pneumatic) pistons, movable along a longitudinal axis, which constitute means for picking up the objects of the package 3 freed from the film 2.

The platform 24 is connected to an actuator (not illustrated) connected in turn to the control means.

Operatively, the platform 24 is moved into the first position to enable the pick-up means to take hold of the bundle of objects when the film 2 has been removed and the objects of the package are free from the film 2, thus constituting a bundle of objects. When the platform 24 is in the first position, the pistons (i.e. said means for picking up the objects) are activated so as to press the objects at the ends of the bundle along the longitudinal axis of the package (that is, of the bundle of objects), toward the centre of the bundle, in order to maintain the objects in a compact bundle. Said pick-up means continue to act on the objects at either end of the bundle, while the platform 24 is moved by the actuator from the first to the second position. By virtue of such movement of the platform 24, the pick-up means lead the bundle of objects freed from the film 2 from the removal station 8 to the exit station 19, along a path defined by the cam 25.

The exit station 19 is defined by a guide, that is a semi tubular-shaped trough 26.

The trough 26 preferably extends in a longitudinal direction.

When the platform 24 is in the second position, the bundle of objects is in the trough 26 in the exit station 19, and, initially, the pick-up means are operatively active on the bundle to maintain it compact and prevent the individual objects falling or flipping over.

Therefore, the apparatus 1 comprises pick-up means associated with the platform 24, which moves along a predefined path in order to pick up the bundle made up of the objects of the package 3 free of the film 2 and transfer it (maintaining it whole and compact) from the removal station 8 to an exit station 19.

Hence, the bundle of objects freed from the film 2 in the removal station 8 is not conveyed into the exit station 19 by gravity, but is rather led by a structure integrally movable with it and able to maintain the objects of the bundle united.

When the bundle is in the exit station 19 and the pick-up means are still operatively active on the bundle, a pusher is positioned in contact with the first of the objects in the bundle, in the direction of movement of the bundle leaving the apparatus 1; this enables the pick-up means to release the bundle and move integrally with the platform 24 from the second to the first position, to pick up a new bundle. In this regard, it should be considered that the apparatus 1 and the method according to the present invention are designed for operation in a continuous cycle.

The opposite end of the bundle (i.e. the last of the objects in the bundle, in the direction of movement of the bundle leaving the apparatus 1) is disposed at the back of the first object of the previously handled bundle (so it does not fall).

During the action of the pusher, a pusher finger 27 is positioned in contact with the first of the objects in the bundle, in the direction of movement of the bundle leaving the apparatus 1.

The pusher finger is movable (transversely to the axis of the bundle disposed in the exit station 19) between an extracted position, in which it is able to push the bundle in the longitudinal direction of the axis of the bundle itself, and a retracted position of non-interference with the bundle;

Furthermore, the pusher finger 27 is movable longitudinally to the axis of the bundle disposed in the exit station 19 between a rearward position, in which it is in contact with the first of the objects in the bundle disposed in the exit station 19, and a forward position (in the direction of travel of the bundles leaving the apparatus 1).

During the movement from the rearward position to the forward one, the pusher finger 27 is in the extracted position and travels by an amount substantially equal to the length of the bundle; during the movement from the forward position to the rearward one, it is in the retracted position and travels by the same amount.

It should be observed that the packages, during their movement inside the apparatus 1 from the storage container 20 to the exit station 19, are preferably always disposed along their longitudinal axis (i.e. with their axis always parallel to itself and disposed longitudinally) and follow a trajectory perpendicular to said axis (i.e. they move along a path transverse to said longitudinal axis).

In contrast, as regards the movement of the bundle of objects from the exit station 19 onward (upon leaving the apparatus 1), the bundle is moved in the direction of the longitudinal axis of the bundle of objects.

It should be observed that the control means are programmed to maintain the rollers in a predetermined operational configuration (e.g. the one in which the rollers stretch the lateral portions 13 and 14 of the film 2, illustrated in FIG. 5) for a predetermined wait time.

This predetermined wait time, which is preferably shorter than 3 seconds and more preferably in the range of 0.5 to 1 second, is advantageous since it increases the likelihood of the film 2 being torn in the stretched portion; that is to say, it allows the film 2 to be torn with low levels of pressure applied by the rollers on the package 3.

The apparatus 1 also comprises an interface 28 connected to the control means so as to enable an operator to set predetermined parameters for the operation of the apparatus.

The interface 28 preferably comprises a display and a plurality of control members (e.g. pushbuttons) to enable the operator to view and program, respectively, predetermined input and output values of the electronic card constituting the control means.

Said interface 28 is preferably associated with a head mounted on an arm 29 rotatably connected to the frame 4, so as to enable, advantageously, the operator to move the interface in the desired position relative to the frame 4.

Preferably, the interface 28 is operatively connected to the control means to enable adjustment or setting of the rotation speed of the rollers, said wait time, or the pressure exerted by the second pair 12 of rollers on the package 3 in the removal station 8.

In this regard, it is envisaged, innovatively, that the apparatus 1 will comprise means for adjusting the speed of the rollers. Indeed, it is envisaged that the rollers will have a variable speed. For this purpose it is planned to use an inverter (not illustrated) connected to the control means and to the motor drives of the rollers in order to control them.

This advantageously allows the speed of the rollers to be adapted to the type of package 3 handled and to be optimised also based upon the type of film 2 used for the package 3.

A preferred value of the rotation speed of the rollers is 50-70 rpm, or 6-7 m/s of tangential peripheral speed.

The present invention also provides a method for removing a film 2 of a package 3 of objects having a shape elongated along a longitudinal axis.

This method comprises the following phases, in succession:

- placing of the package 3 on a first pair 7 of rollers comprising a first roller 5 and a second roller 6 disposed (preferably along parallel longitudinal axes) so as to support the package 3 in a station 8 for the removal of the film 2;
- moving of a second pair 12 of rollers, comprising a third roller 10 and a fourth roller 11 connected to a second motor drive, from a raised position of non-interference with the package 3 disposed in the removal station 8, to a lowered position, in which the second pair 12 of rollers bears down upon the package 3, pressing it against the first pair 7 of rollers;

rotating movement of the rollers around their longitudinal axes, in such a way as to stretch lateral portions 13 and 14 of the film 2 disposed between the surfaces in contact with said first and second pair of rollers, thereby causing it to tear;

removing of the film 2 by the first pair 7 of rollers.

It should be observed that, during said phase of moving:

the first roller 5 and the second roller 6 rotate in opposite directions, in such a way that the surfaces contacting with the film 2 of the package 3 disposed in the removal station 8 instantly move closer to each other (so that the upper portion 15 of the film 2 disposed between the surfaces of the film 2 in contact with the first roller 5 and with the second roller 6 is slackened and lifted away from the bundle of objects of the package 3);

the third roller 10 and the fourth roller 12 rotate in opposite directions, in such a way that the surfaces contacting with the film 2 of the package 3 disposed in the removal station 8 instantly move closer to each other (so that the upper portion 15 of the film 2 disposed between the surfaces of the film 2 in contact with the first roller 5 and with the second roller 6 is slackened and lifted away from the bundle of objects of the package 3).

Said phase of moving is illustrated in FIG. 5.

The method according to the present invention also comprises, between the moving phase and the removing phase, an additional moving phase of the rollers, which may overlap the removing phase, wherein:

the first roller 5 and the second roller 6 rotate in opposite directions, in such a way that the surfaces contacting with the film 2 of the package 3 disposed in the removal station 8 instantly move closer to each other;

the third roller 10 and the fourth roller 11 rotate in opposite directions, in such a way that the surfaces contacting with the film 2 of the package 3 disposed in the removal station 8 instantly move away from each other, so as to stretch a portion 15 of film disposed between said contacting surfaces.

Therefore, the transition from the first phase of moving of the rollers to the additional phase of moving of the rollers involves, innovatively, a reversal in the direction of rotation of the rollers 10 and 11 of the second pair 12 of rollers.

This additional phase of moving is illustrated in FIG. 6.

The method also comprises a waiting phase which follows the moving phase (and precedes the additional moving phase), so that said portions 13 and 14 of the film 2 may be kept stretched for a predetermined amount of time.

Said predetermined amount of time (i.e. the duration of the waiting phase) is preferably shorter than 3 seconds, more preferably in the range of 0.5 to 1 second.

The method according to the present invention also preferably comprises a cutting phase in which the upper portion 15 of the film disposed between the surfaces in contact with the first roller 5 and the second roller 6 is cut. During this phase, the rotating blades or retractable needles slide along the longitudinal axis of the package 3 in such a way as to make cuts or punch holes in the upper portion 15 of the film in various points.

Said cutting phase is preferably implemented during the movement phase, in which said portion 15 of the film 2 is raised in relation to the objects of the package 3.

More generally speaking, the method according to the present invention comprises the following phases, in succession:

feeding of a package 3 from the storage container 20 of the packages 3 to an entry station 18;

detecting of the presence of the package 3 in the entry station 18;

conveying of the package 3 from the entry station 18 to the removal station 8 and consequent placing of the package 3 on the first pair 7 of rollers;

moving of the second pair 12 of rollers from the raised position to the lowered one so as to interact with the first pair 7 of rollers, thereby holding the package 3 in place in the removal station 8 by bearing down upon the film 2;

moving of the rollers to stretch the lateral portions 13 and 14 of the film 2;

waiting, during which the rollers are maintained in the configuration of the movement phase, so as keep the lateral portions 13 and 14 of the film 2 stretched for a predetermined amount of time;

optional cutting of the upper portion 15 of the film 2 lifted away from the objects of the package, during said movement phase and/or during said waiting phase;

additional moving of the rollers (with reversal in the direction of rotation of the second pair 12 of rollers, relative to the preceding movement phase), so as to stretch the upper portion 15 of the film 2;

removing of the film 2 by the first pair 7 of rollers, with progressive recovery of the lower portion 16 of the film 2 and passage of the film 2 between the first roller 5 and the second roller 6;

holding in place of the bundle of objects of the package 3 freed from the film 2, by virtue of the action of pick-up means active longitudinally on both ends of the bundle disposed in the removal station 8;

transferring the bundle of objects from the removal station 8 to the exit station 19 along a pre-established path;

pushing the bundle of objects away from the station 19.

Said feeding phase preferably occurs by means of the conveyor belt 21, according to what was described in relation to the apparatus 1.

Said detecting phase preferably occurs by means of a photocell connected to the control means, according to what was described in relation to the apparatus 1.

Said conveying phase preferably occurs by means of a movement (corresponding, for example, to a step of the motor 22) of the conveyor belt 21 serving to push the package 3 into the chute 23, so that the package will roll along the chute 23 and into the removal station 8 (according to what was described in relation to the apparatus 1).

Said removing phase is substantially simultaneous with the additional moving phase.

In said transferring phase, said pre-established path is defined by the cam 25 with which the platform 24 is slidingly engaged.

During said transferring phase the pick-up means continue to act upon the bundle to maintain it compact.

In said pushing phase the bundle of objects is made to slide along a guide, i.e. a trough, disposed along the longitudinal axis of the bundle of objects disposed in the exit station 19.

According to the method described in the present invention, the rollers used preferably have the technical characteristics described above in relation to the apparatus 1.

The apparatus and method according to the present invention provide the following advantages.

The present invention enables the film 2 to be removed from the package 3 by exerting a mechanical action to stretch predefined portions of the film 2, without there being any need to cut the film 2 (along the longitudinal axis of the package).

This makes it possible to obtain such removal in a particularly short time and in a particularly reliable manner. Moreover, it allows the film to be removed without any risk of damaging the objects and without any of the health risks for operators which might be connected to exposing the film to sources of heat to induce the tearing thereof.

The time necessary for removing the film 2 from the package is not dependent upon the length (i.e. the longitudinal extension) of the package.

The present invention is particularly fast and efficient, since the same rollers simultaneously perform the following essential functions: they support the package 3 in the cutting station 8, tear the film 2 and remove the film itself, discharging it from the removal station in a predetermined direction (downwardly).

Therefore, the present invention provides an apparatus and a method for removing a film of a package of objects in a particularly fast and efficient manner without denting or damaging the objects.

The invention claimed is:

1. Apparatus for removing a film from a package of objects having a shape elongated along a longitudinal axis, having:

a first and a second roller defining a first pair of rollers each rotatable about a respective roller axis, for supporting the package in a configuration with the longitudinal axis extending parallel to the roller axes in a station for the removal of the film, the rollers connected to a first motor drive serving to rotate them around said roller axes;

a third and a fourth roller defining a second pair of rollers, movable between a raised position of non-interference with the package disposed in the removal station and a lowered position, in which the third and fourth rollers bear down upon the package, pressing it against said first and second roller;

means for tearing the film of the package disposed in the removal station so as to allow the removal thereof by the first pair of rollers, wherein the means for tearing the film comprise a second motor drive, which is connected to the second pair of rollers and rotates them around their longitudinal axes, in such a way as to stretch portions of the film disposed between surfaces of the film that are in contact with said first and second pair of rollers, thereby causing the film to tear, and wherein the means for tearing the film further have:

means for reversing the direction of rotation of the third and fourth roller cooperating with said second motor drive;

and control means connected to said first and second motor drives and to said reversing means for enabling selective alternate stretching of: said portions of the film disposed between the surfaces of the film that are in contact with the first and second pairs of rollers, and a portion of the film disposed between surfaces of the film that are in contact with said third and fourth rollers.

2. Apparatus according to claim 1, wherein the first motor drive is operatively connected to the first and second roller in order to rotate them in opposite directions, in such a way that surfaces of the first and second rollers contacting with the film of the package disposed in the removal station instantly move closer to each other.

3. Apparatus according to claim 1, wherein the second motor drive is operatively connected to the third roller and to the fourth roller in order to rotate them in opposite directions, in such a way that surfaces of the third and fourth rollers contacting with the film of the package disposed in the removal station instantly move closer to each other.

4. Apparatus according to claim 1, having means for cutting the film, operatively active on the portion of the film of the package disposed in the removal station which lies between the surfaces of the film in contact with the third and the fourth rollers, said cutting means interacting with the second motor drive so as to make cuts in the film when said portion between the surfaces of the film in contact with the third and fourth rollers is lifted away from the objects of the package by virtue of rotation of the second pair of rollers.

5. Apparatus according to claim 4, having a carriage movable between a lowered position and a raised one, the second pair of rollers and the means for cutting being associated with said carriage.

6. Apparatus according to claim 1, wherein said rollers have rough lateral surfaces in order to provide friction across the contact surfaces between the rollers and the film of the package disposed in the removal station.

7. Apparatus according to claim 6, wherein said lateral surfaces are provided with a helical profile.

8. Apparatus according to claim 1, wherein said rollers each have a lateral layer of predetermined hardness in order to provide friction across the contact surfaces between the rollers and the film of the package disposed in the removal station.

9. Apparatus according to claim 1, wherein pick-up means are associated with a platform which moves along a predefined path in order to pick up a bundle made up of the objects of the package free of the film and transfer the bundle from the removal station to an exit station defined by the apparatus.

* * * * *